US010900234B2

(12) United States Patent
Dressel

(10) Patent No.: US 10,900,234 B2
(45) Date of Patent: Jan. 26, 2021

(54) GUTTER COVER SYSTEM

(71) Applicant: Brock Dressel, Milwaukie, OR (US)

(72) Inventor: Brock Dressel, Milwaukie, OR (US)

( * ) Notice: Subject to any disclaimer, the term of this patent is extended or adjusted under 35 U.S.C. 154(b) by 0 days.

(21) Appl. No.: 16/579,270

(22) Filed: Sep. 23, 2019

(65) Prior Publication Data

US 2020/0095771 A1 Mar. 26, 2020

Related U.S. Application Data

(60) Provisional application No. 62/734,826, filed on Sep. 21, 2018.

(51) Int. Cl.
*E04D 13/076* (2006.01)

(52) U.S. Cl.
CPC ..... *E04D 13/076* (2013.01)

(58) Field of Classification Search
CPC . E04D 13/064; E04D 13/068; E04D 13/0685; E04D 13/0727; E04D 13/076; E04D 13/0725; E04D 13/0841; E04D 13/072; E04D 13/0722; E04D 13/0767; E04D 2013/0486
USPC ..... 52/11, 12
See application file for complete search history.

(56) References Cited

U.S. PATENT DOCUMENTS 2,613,621 A * 10/1952 Schraeder ..... E04D 13/076 52/12
4,195,452 A * 4/1980 Smith ..... E04D 13/0725 248/48.1
5,388,377 A * 2/1995 Faulkner ..... E04D 13/0725 52/11
5,595,027 A * 1/1997 Vail ..... E04D 13/076 52/11
5,737,879 A * 4/1998 Sweet ..... E04D 13/0725 248/48.1
5,862,631 A * 1/1999 Attaway ..... E04D 13/0722 52/11
6,016,631 A * 1/2000 Lowrie, III ..... E04D 13/076 52/12
6,098,344 A * 8/2000 Albracht ..... E04D 13/076 52/12
6,161,338 A * 12/2000 Kuhns ..... E04D 13/076 210/474
6,367,743 B1 * 4/2002 Iannelli ..... E04D 13/0725 248/48.1
6,412,228 B1 * 7/2002 Meckstroth ..... E04D 13/076 210/474
6,442,904 B1 * 9/2002 Ortiz ..... E04D 13/0725 52/11

(Continued)

FOREIGN PATENT DOCUMENTS

DE 4439958 A1 * 5/1996 ..... E04D 13/076

*Primary Examiner* — Kyle J. Walraed-Sullivan
(74) *Attorney, Agent, or Firm* — Alleman Hall Creasman & Tuttle LLP

(57) ABSTRACT

A gutter cover system includes a gutter section forming an open channel, and a gutter cover section including a header and a plurality of bristles coupled to the header. The header of the gutter cover section has a longitudinal axis that is located along a first side wall of the gutter section. The plurality of bristles project outward from the header and span at least a portion of the open channel of the gutter section from the first side wall towards a second side wall of the gutter section.

15 Claims, 7 Drawing Sheets

(56) References Cited

U.S. PATENT DOCUMENTS 6,701,674 B1 * 3/2004 Albracht ..... E04D 13/0725 52/11
6,932,911 B1 * 8/2005 Groth ..... E04D 13/076 210/162
7,104,012 B1 * 9/2006 Bayram ..... E04D 13/076 219/213
8,402,697 B1 * 3/2013 Ealer, Sr. ..... E04D 13/076 52/12
9,003,714 B2 * 4/2015 Vance ..... E04D 13/076 210/510.1
9,163,406 B1 * 10/2015 Ealer, Sr. ..... E04D 13/076
10,376,946 B1 * 8/2019 Ealer, Sr. ..... E04D 13/064
10,472,829 B1 * 11/2019 Froehlich ..... E04D 13/076
10,480,194 B1 * 11/2019 Szafranski ..... E04D 13/076
2002/0166290 A1 * 11/2002 Bergeron ..... E04D 13/076 52/12
2003/0046876 A1 * 3/2003 Higginbotham ..... E04D 13/076 52/11
2004/0244303 A1 * 12/2004 Seise, Jr. ..... E04D 13/076 52/12
2005/0016077 A1 * 1/2005 Gramling ..... E04D 13/0722 52/11
2005/0034376 A1 * 2/2005 Pourdeyhimi ..... E04D 13/076 52/11
2005/0204641 A1 * 9/2005 Collister ..... E04D 13/0725 52/11
2005/0247611 A1 * 11/2005 Groth ..... E04D 13/076 210/162
2005/0274082 A1 * 12/2005 Welty ..... E04D 13/076 52/120
2006/0021286 A1 * 2/2006 Saville, Jr. ..... E04D 13/076 52/15
2006/0053696 A1 * 3/2006 Gramling ..... E04D 13/0727 52/11
2006/0053697 A1 * 3/2006 Higginbotham ..... E04D 13/076 52/12
2006/0101722 A1 * 5/2006 Ealer, Sr. ..... E04D 13/076 52/12
2006/0117672 A1 * 6/2006 Kurple ..... E04D 13/076 52/12
2006/0265968 A1 * 11/2006 Lowrie, III ..... E04D 13/064 52/11
2007/0017162 A1 * 1/2007 Staub ..... E04D 13/076 52/11
2007/0044387 A1 * 3/2007 Herrera ..... E04D 13/0459 52/12
2007/0169423 A1 * 7/2007 Brochu ..... E04D 13/076 52/12
2007/0199249 A1 * 8/2007 Beck ..... E04D 13/076 52/12
2007/0214730 A1 * 9/2007 Cota ..... E04D 13/076 52/12
2008/0000169 A1 * 1/2008 Handley ..... B29C 48/001 52/12
2008/0010906 A1 * 1/2008 Brochu ..... E04D 13/076 52/12
2008/0047206 A1 * 2/2008 Gramling ..... E04D 13/0725 52/12
2008/0098661 A1 * 5/2008 McCann ..... E04D 13/076 52/12
2009/0031638 A1 * 2/2009 Iannelli ..... E04D 13/076 52/12
2009/0031640 A1 * 2/2009 Elmes ..... E04D 13/02 52/60
2009/0108144 A1 * 4/2009 Brochu ..... E04D 13/076 248/48.1
2009/0249704 A1 * 10/2009 Wilson ..... E04D 13/076 52/12
2010/0071273 A1 * 3/2010 Joly, Jr. ..... E04D 13/076 52/12
2010/0170837 A1 * 7/2010 Konkey ..... E04D 13/076 210/162
2011/0099916 A1 * 5/2011 Minor, Sr. ..... E04D 13/0725 52/11
2011/0107683 A1 * 5/2011 Ringuette ..... E04D 13/076 52/12
2011/0126477 A1 * 6/2011 Hum ..... E04D 13/076 52/12
2012/0168419 A1 * 7/2012 Bublitz ..... E04D 13/0762 219/213
2013/0145699 A1 * 6/2013 Olthoff ..... E04D 13/076 52/12
2014/0215929 A1 * 8/2014 Lenney ..... E04D 13/076 52/12
2014/0223837 A1 * 8/2014 Pavlansky ..... E04D 13/0767 52/12
2014/0259969 A1 * 9/2014 Nelson ..... E04D 13/0767 52/12
2015/0089883 A1 * 4/2015 Peck ..... E04D 13/076 52/12
2016/0102459 A1 * 4/2016 Breyer ..... E04D 13/0767 52/12
2016/0201329 A1 * 7/2016 Ianelli ..... E04D 13/072 52/12
2017/0058531 A1 * 3/2017 Brochu ..... E04D 13/076
2017/0204611 A1 * 7/2017 Brochu ..... E04D 13/064
2018/0030733 A1 * 2/2018 Brochu ..... E04D 13/064
2018/0127981 A1 * 5/2018 Brochu ..... E04D 13/076
2019/0071874 A1 * 3/2019 Brochu ..... E04D 13/076
2019/0136536 A1 * 5/2019 Brochu ..... E04D 13/0725
2020/0032518 A1 * 1/2020 Froehlich ..... E04D 13/076

* cited by examiner

GUTTER COVER SYSTEM

CROSS REFERENCE TO RELATED APPLICATIONS

This application claims priority to U.S. provisional patent application No. 62/734,826, filed Sep. 21, 2018, the entirety of which is hereby incorporated herein by reference for all purposes.

BACKGROUND

Gutters are a standard feature on most types of modern building construction. Typically, gutter systems are arranged along the perimeter of a roof such that rainwater that has fallen onto the roof of a building is collected by multiple linked gutter sections. The rainwater is then conveyed by the gutter sections and fed to a downspout that will divert the collected rainwater to a street sewer system. One problem with conventional gutter systems, however, is that along with rainwater, often times debris such as leaves, pine needles, or dirt may be washed into a gutter section. Without an effective way of preventing debris from entering a gutter section, debris build-up may occur that can reduce the effectiveness of a gutter system. For example, if left unchecked, debris build-up can result in clogged gutter sections and/or downspouts that may cause a gutter section (s) to overflow.

SUMMARY

According to an example of the present disclosure, a gutter cover system includes a gutter section forming an open channel, and a gutter cover section including a header and a plurality of bristles coupled to the header. The header of the gutter cover section has a longitudinal axis that is located along a first side wall of the gutter section. The plurality of bristles project outward from the header and span at least a portion of the open channel of the gutter section from the first side wall towards a second side wall of the gutter section. The plurality of bristles may thereby form a cover over the gutter section that reduces or inhibits debris from passing therethrough, but allows rainwater to fall through interstitial gaps formed between adjacent bristles. The rainwater passing through in this manner may be collected by the gutter section and guided away from the structure. Furthermore, the bristles may act to retain leaves, pine needles and other debris, at least temporarily, such that easier removal of the debris may be facilitated. The bristles may also enable a person to access the gutter section to facilitate cleaning without requiring that the cutter cover section be removed.

DETAILED DESCRIPTION

According to an example of the present disclosure, a gutter cover system includes a gutter section forming an open channel, and a gutter cover section including a header and a plurality of bristles coupled to the header. The header of the gutter cover section has a longitudinal axis that is located along a first side wall of the gutter section. The plurality of bristles project outward from the header and span at least a portion of the open channel of the gutter section from the first side wall towards a second side wall of the gutter section. The plurality of bristles may thereby form a cover over the gutter section that reduces or inhibits debris from passing therethrough, but allows rainwater to fall through interstitial gaps formed between adjacent bristles. The rainwater passing through in this manner may be collected by the gutter section and guided away from the structure. Furthermore, the bristles may act to retain leaves, pine needles and other debris, at least temporarily, such that easier removal of the debris may be facilitated. The bristles may also enable a person to access the gutter section to facilitate cleaning without requiring that the cutter cover section be removed.

Figure 1B:
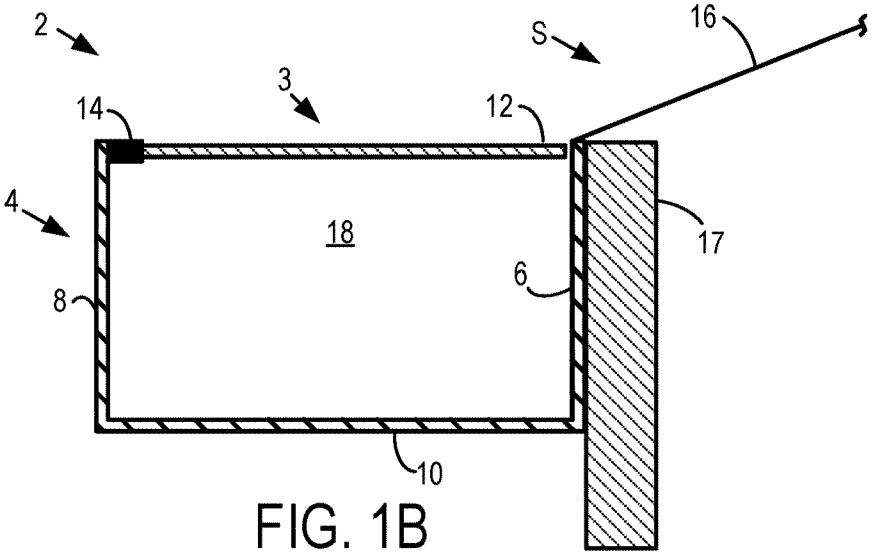
FIG. 1B depicts a cross-sectional side-view of a second embodiment of a gutter cover system for a structure.
Figure 1A:
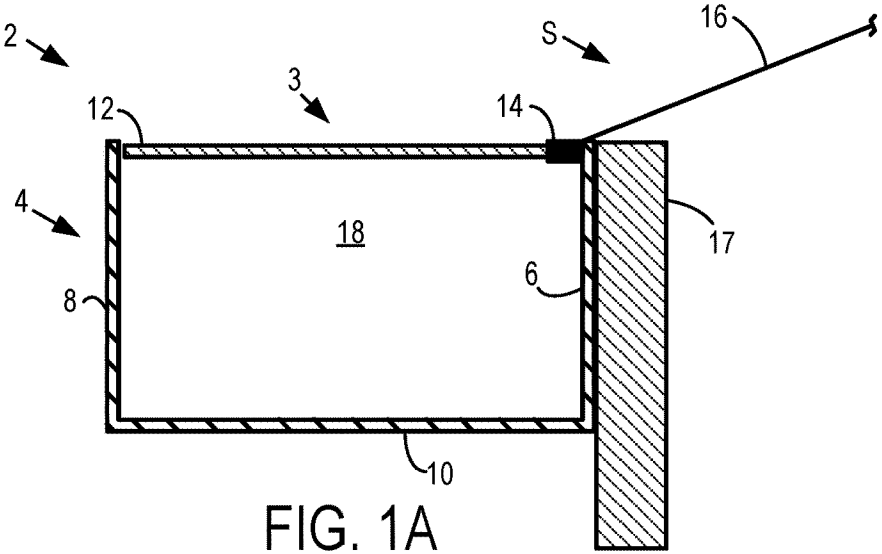
FIG. 1A depicts a cross-sectional side-view of a first embodiment of a gutter cover system for a structure.

FIG. 1A shows a cross-sectional side-view of a first embodiment of a gutter cover system 2 for a structure S. Gutter cover system 2 may include a gutter cover 3 attached to a gutter section 4. Gutter cover 3 includes a plurality of filament-shaped bristles 12 that are coupled to a header 14. Header 14, in turn, may be coupled to a first side section 6 (e.g., first side wall) of gutter section 4, which is proximate to a fascia 17 of structure S. By way of example, header 14 may be screwed, riveted, bolted, adhered by adhesive, or otherwise fastened to gutter section 4. In other embodiments, header 14 may be partially or fully mechanically coupled to roof 16, fascia 17, or another suitable building component, such as an overhang or an exterior wall, for example.

Header 14 may have a longitudinal axis that is perpendicular to the plane of FIG. 1. The plurality of bristles 12 may extend away from header 14 such that each of the plurality of bristles is substantially perpendicular to the longitudinal axis of header 14. As such, the plurality of bristles 12 may be configured to extend out over an open channel 18 formed by gutter section 4, effectively covering the open channel.

The plurality of bristles 12 and/or header 14 may be made of a flexible material, such as plastic, rubber, metal, or composite material, or a combination thereof. Each of the plurality of bristles may be mechanically coupled to header 14. For example, each of the plurality of bristles 12 may be folded, tied, welded, glued, stapled, screwed, riveted, bound, clamped or otherwise mechanically fastened to header 14. Additionally, header 14 may be configured with receptacles capable of receiving a grouping of bristles. As one non-limiting example, header 14 may be configured with 40 holes, 45 holes, or 50 holes per foot long section of header, with each hole receiving between 12 bristles and 20 bristles each that are mechanically coupled to header 14. In other embodiments, gutter cover 3 may be configured as a monolith where the plurality of bristles and header are initially molded and/or formed as an integral entity.

At least a portion of each of the plurality of bristles may be configured such that there is a gap between adjacent bristles or grouping of bristles. As such, rainwater that has fallen onto roof 16 and cascaded down from the roof may be allowed to pass through the gaps formed between adjacent groupings of bristles. Rainwater may thereafter be collected by the gutter section in a typical fashion and diverted along bottom section 10 of gutter section 4 to a downspout or other water transferring appurtenance. The plurality of bristles (or groupings of bristles) are spaced, however, such that the gaps formed between adjacent bristles will inhibit the passing of leaves, pine needles, and other such debris therethrough. Thereby, a versatile device may be realized that maintains a cleaner gutter section and collects the debris such that easier removal of the debris is facilitated.

In some embodiments, the plurality of bristles 12 may be configured with surface characteristics that provide reduced surface friction to debris in contact therewith. This may allow for easier cleaning and an increased amount of debris generally being blown off of the gutter cover by wind gusts in the proximity of the gutter section, particularly once the debris has dried after a precipitation event, resulting in a reduction of the amount of debris resting on the gutter cover 3.

FIG. 1B shows a cross-sectional side-view of a second embodiment of a gutter cover system 2 for a structure S. In this embodiment, header 14 may be coupled to a second side section 8 (e.g., second side wall) of gutter section 4 which is distal or further from fascia 17 than first side 6.

Figure 2:
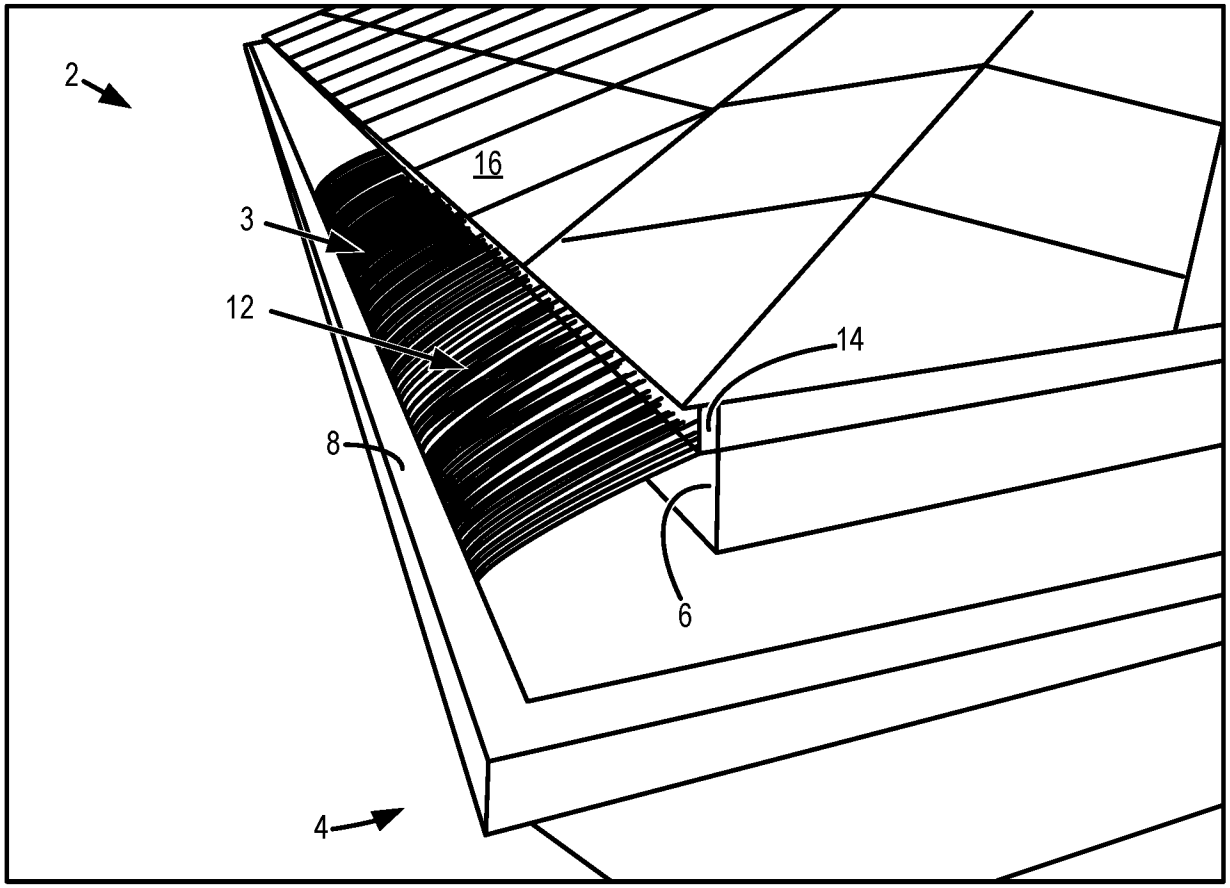
FIG. 2 depicts a view of the first embodiment of the gutter cover system for a structure in accordance with the first embodiment of FIG. 1A.

FIG. 2 depicts an example of gutter cover system 2 according to the first embodiment. As illustrated, header 14 is coupled to first side section 6 of gutter section 8. This configuration allows the plurality of bristles 12 to extend out away from roof 16 to the second side section 8 of gutter section 4. Open channel 18 of gutter section 4 may thereby be effectively covered by the plurality of bristles 12 of gutter cover 3. Rainwater that has cascaded off of roof 16 may be allowed to pass through gaps formed between adjacent bristles (or grouping of bristles) and be collected by gutter section 4. Contrastingly, the plurality of bristles may inhibit leaves, pine needles, dirt, or other debris from entering the open channel 18 of gutter section 4.

As shown in FIG. 2, the plurality of bristles 12 may be arranged in groups such that a collective thickness of the plurality of bristles is greater than a thickness of a single bristle. The collective resistance of the plurality of bristles to deflection caused by debris loading may thereby be increased. As such, the capacity of gutter cover 3 to prevent debris from entering open channel 18 of gutter section 4 may be increased. Furthermore, gutter cover 3 may be configured (or mounted) such that the plurality of bristles 12 extend outward from header 14 at an angle that maintains the bristles as being substantially parallel to the roofline of roof 16, in at least some examples. This configuration may further facilitate debris being blown or swept off of gutter cover 3 and correspondingly reduce the amount of debris collected on the gutter cover. However, in other examples, the bristles may be orientated at a different angle than the roofline, such as described in further detail with reference to FIG. 6.

Figure 3:
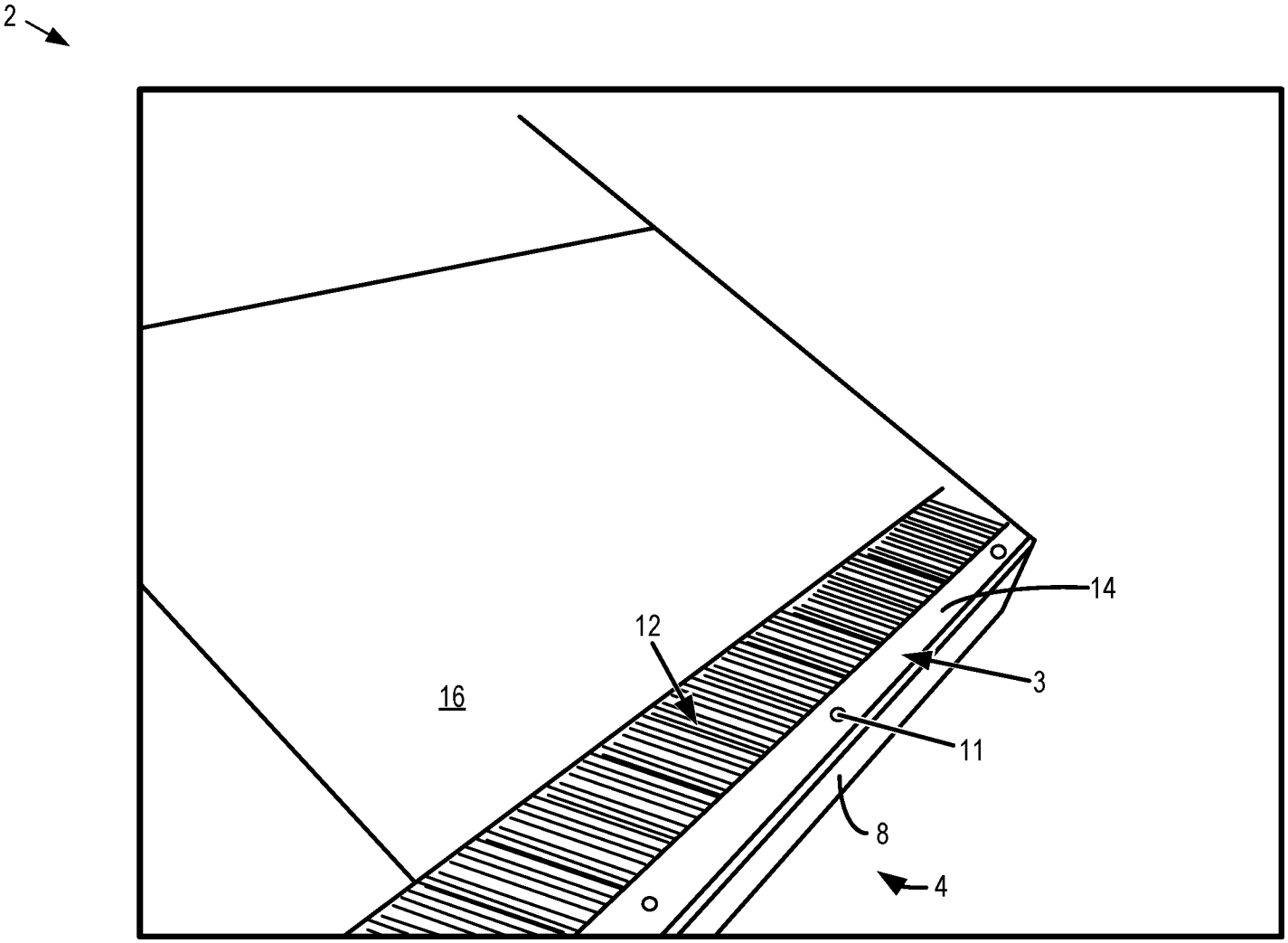
FIG. 3 depicts a view of the second embodiment of a gutter cover system for a structure in accordance with the second embodiment of FIG. 1B.

FIG. 3 depicts an example of gutter cover system 2 according to a second embodiment. Header 14 may be mechanically coupled (e.g., bolted, screwed, clamped, folded over, hooked, riveted, glued, welded, etc.) to the second side section 8 of gutter section 4. Such a configuration may be advantageous when mounting to the header 14 to the first side section 6 of gutter section 4 or mounting to roof 16 (or other building component) would be problematic. With such a configuration, the plurality of bristles 12 may extend perpendicularly outward from a longitudinal axis of header 14 and towards roof 16.

Figure 4:
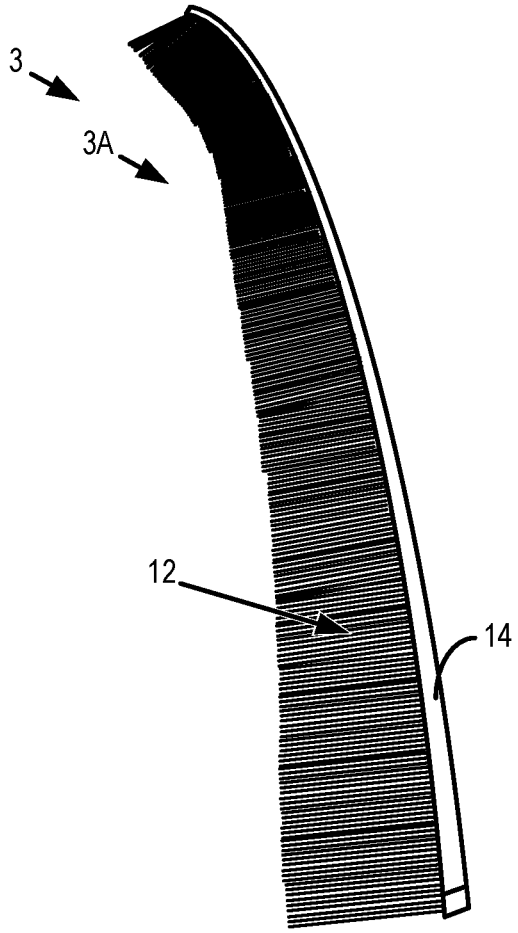
FIG. 4 depicts a view of an un-installed, free-standing, gutter cover section according to an example of the present disclosure.

FIG. 4 depicts an example of an un-installed, free-standing, gutter cover section 3A of gutter cover 3. In this example, the gutter cover section is approximately 48 inches in length. In other examples, the gutter cover section may be 12, 18, 36, 60, or 96 inches in length or other suitable length, as non-limiting examples. In yet other examples, the gutter cover may be transported and/or sold as a long gutter cover section (e.g., 50 feet, 100 feet, etc.) in a rolled configuration, and thereafter "rolled out" and cut to specification in a factory or at a jobsite for a particular length of gutter. Additionally, in at least some examples, the gutter cover section may be detachable from a gutter section (or other building component) to which it is coupled (when installed) such that easier cleaning of the gutter cover system is facilitated. The effective length of the plurality of bristles (i.e. the length of bristle that extends out away from header 14) may be 3 inches, 4 inches, 6 inches, or other suitable length that accommodates and at least partially or entirely spans the particular gutter from the first wall to the second wall of the gutter.

Figure 5:
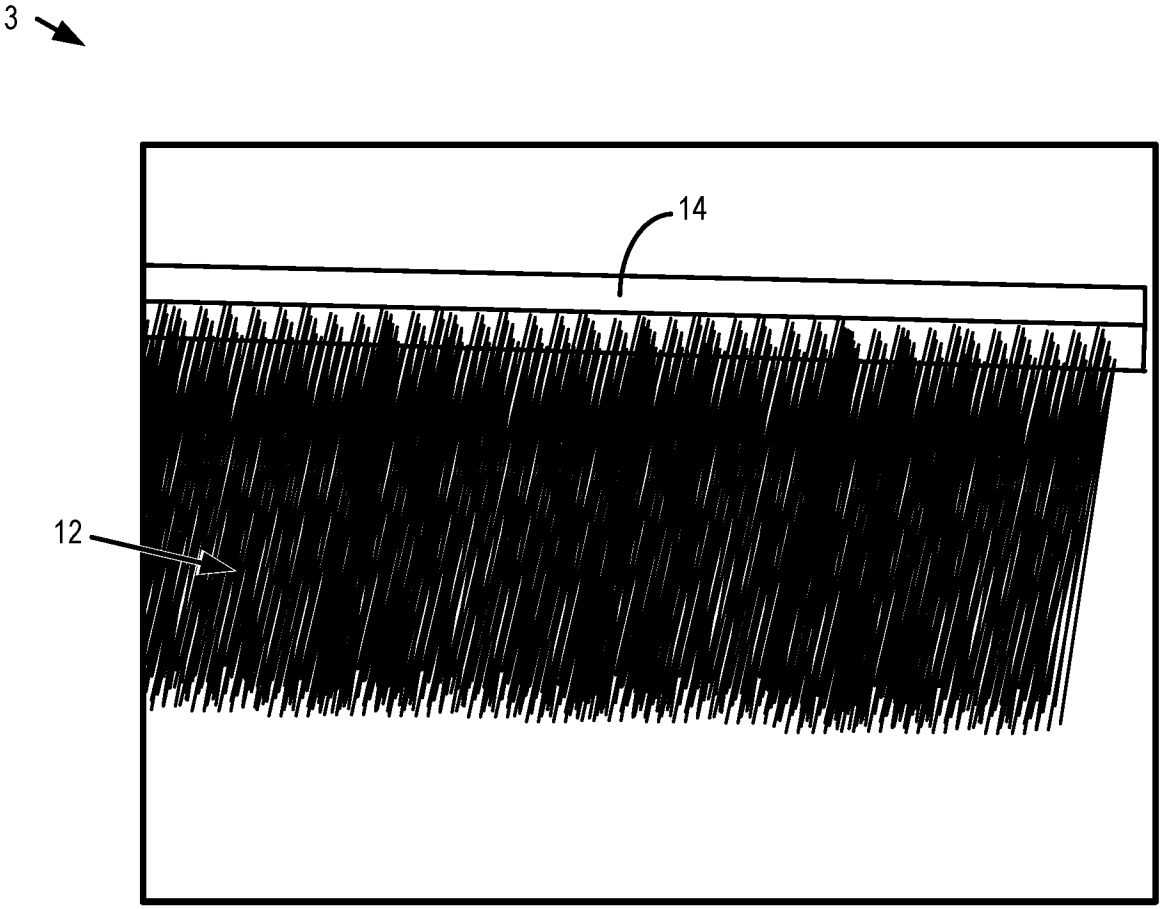
FIG. 5 depicts another view of the un-installed, free-standing, gutter cover section of FIG. 4 in further detail.

FIG. 5 depicts an example of the un-installed, free-standing, gutter cover section of gutter cover 3. As illustrated, the plurality of bristles, 14 may be configured in groupings of individual bristles with multiple bristle groupings populating the length of header 14. Additionally, the bristles may be layered in groups of one or more bristles along an axis that is orthogonal to the long axis of the header. In other examples, however, each grouping (or substantially vertical row of bristles) may be configured with 1, 2, 3, 5, 6, 10 or other suitable number of individual bristles. Additionally, the cross-sectional thickness or diameter of an individual bristle may be 0.02 inches, 0.03 inches, 0.05 inches, or other suitable value. Also, the cross-sectional shape of header 14, although shown herein as being substantially rectangular, may, in other embodiments, be circular, elliptical, hexagonal, octagonal, or another suitable shape.

Figure 6:
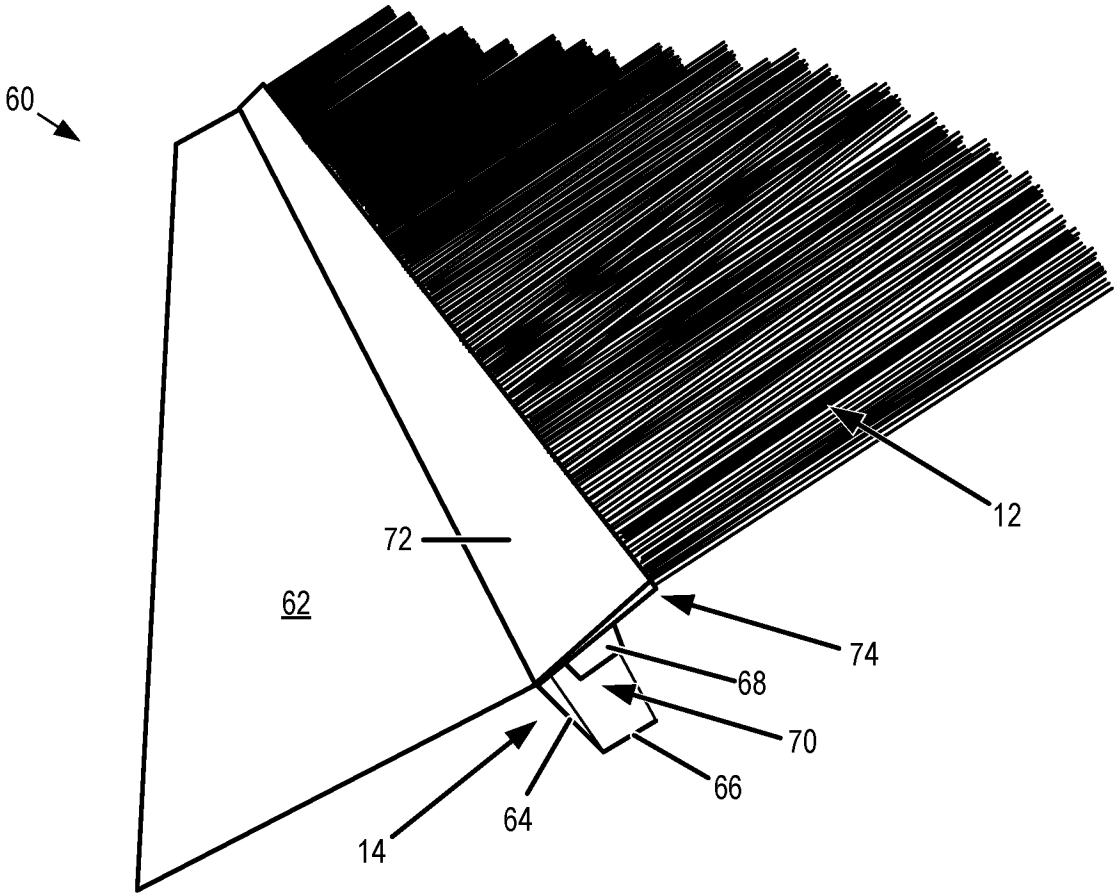
FIG. 6 depicts a view of an example gutter cover section according another example of the present disclosure.
Figure 7:
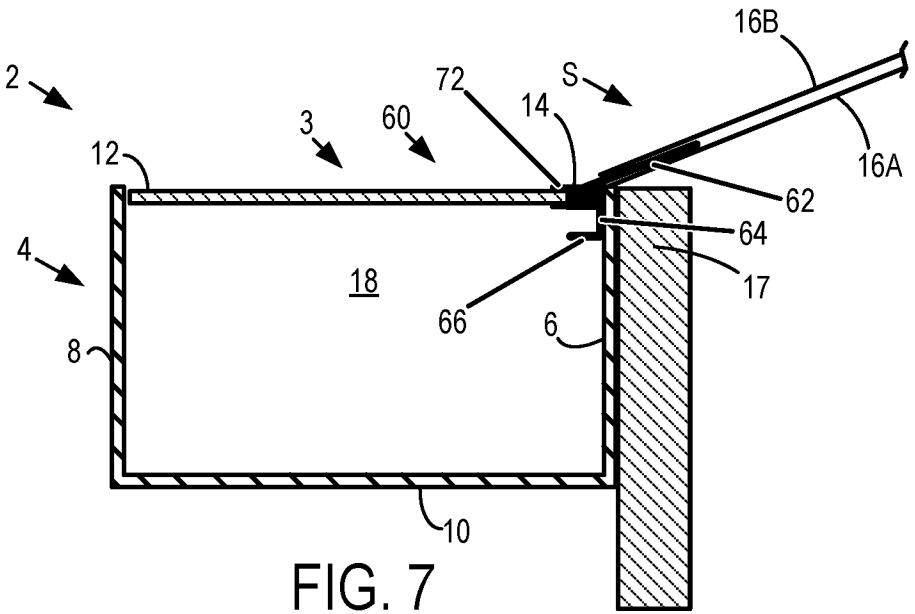
FIG. 7 depicts a cross-sectional side-view of the example gutter cover section of FIG. 6.

FIG. 6 depicts an example of an un-installed gutter cover section 60 in further detail. Gutter cover section 60 is a non-limiting example of previously described gutter cover section 3A. In an example, gutter cover section 60 may be installed according to the configuration depicted in FIGS. 1A and 2 in which the bristles point outwards from the roof. Accordingly, gutter cover section 60 is also a non-limiting example of previously described gutter cover 3. Gutter cover section 60 includes bristles 12 and header 14. In this example, header 14 includes or is joined with a flashing section 62 that may be inserted beneath roofing shingles or other roofing surface material (16B) and between the roofing surface material and the roof surface (16A) to retain gutter cover section 60 in a desired positioning relative to a gutter, such as depicted in FIG. 7. Flashing section 62 may extend an entire length of the gutter cover section (as depicted in FIG. 6), or may take the form of a plurality of flashing segments. Flashing section 62 may take the form of thin sheet metal or alternatively a plastic fin or tab that is sufficiently thin to be inserted beneath roofing materials at the edge of a roof. Further, in this example, header 14 includes an L-shaped or concave section formed by segments 64 and 66, and a header portion 68 that retains bristles 12. However, segment 66 may be omitted in at least some examples.

In an example, segments 64 and 66, and header portion 68 collectively define a region 70. In at least some examples, region 70 may be sized and shaped to accommodate an upper edge and/or exterior sidewall of a gutter to further retain the gutter cover section 60 (in a configuration in which segment 64 is installed between the structure and the gutter at the time of installation of the gutter). Alternatively, in another example depicted in FIG. 7, a rear face of segment 64 opposite region 70 may be inserted inside of the gutter and face a rear internal edge or wall surface of the gutter. In this example, segment 66 may be omitted or may provide additional protection from water passing between the rear face of segment 64 and under the flashing section 62 and the roofing material. Each of segments 64 and 66, and header portion 68 may extend an entire length of the gutter cover section, or may take the form of a plurality of segments. The configuration of segments 64 and 66, and header portion 68 may be used in combination with other examples disclosed herein, including at least the examples of FIGS. 1B and 3. In at least some examples, a single piece of material (e.g., sheet metal) may be used to form flashing section 62, segment 64, segment 66, and flashing section 72 by bending the material back upon itself as indicated at 74. Flashing section 72 may cover header portion 68 and an interface between header portion 68 and bristles 12 to provide additional protection from water incursion into the header/bristle interface.

In an example of the present disclosure, a gutter cover system comprises a gutter section forming an open channel, and a gutter cover section including a header and a plurality of bristles coupled to the header. In an installed configuration, the header has a longitudinal axis that is located along a first side wall of the gutter section, and the plurality of bristles project outward from the header and span at least a portion of the open channel of the gutter section from the first side wall towards a second side wall of the gutter section. In this example or any other example disclosed herein, the gutter cover section further includes a flashing section coupled to the header that projects outward from the header in a direction that opposes the plurality of bristles. The gutter cover system may be mounted to a building structure in which: the gutter section is fastened to the building structure with the first side wall closer to the building structure than a second side wall of the gutter section; and the flashing section is located between a roof of the building structure and a roofing material of the building structure. The flashing section may project outward from the header section at an angle that is less than 180 degrees and greater than 90 degrees relative to the plurality of bristles. This angle may be used, for example, to orientate the bristles at an angle that differs from an angle of the roof, such as a less inclined or more level orientation as compared to the roof. In this example or any other example disclosed herein, the gutter cover section further includes a first segment (e.g., segment 64) projecting from the header at an angle to both the plurality of bristles and the flashing section. The first segment may be located between the first side wall of the gutter section and a building structure to which the gutter cover system is fastened (e.g., in a configuration in which the gutter cover section is installed at the time of installation of the gutter). The gutter cover section may further include a second segment (e.g., segment 66) projecting from a distal end of the first segment in a direction from which the plurality of bristles project from the header section. The first segment and the second segment may form an L-shaped section (or other concave shape) forming a region (e.g., region 70) that accommodates an exterior of the first side wall of the gutter section. Alternatively, the first segment may project downward into the open channel of the gutter section along an interior of the first side wall of the gutter section in an installed configuration. The header may be fastened to the first side wall of the gutter section along the longitudinal axis of the header—e.g., by a plurality of mechanical fasteners (e.g., bolts, screws, rivets, etc. as indicated schematically at 11 in FIG. 3) that are distributed along the longitudinal axis of the header. In this example or any other example disclosed herein, the second side wall of the gutter section may be located closer to a building structure to which the gutter section is fastened than the first side wall of the gutter section such that the plurality of bristles project outward from the header toward the building structure. Alternatively, the second side wall of the gutter section is located further from a building structure to which the gutter section is fastened than the first side wall of the gutter section such that the plurality of bristles project outward from the header away from the building structure. In this example or any other example disclosed herein, the plurality of bristles are arranged in a plurality of layers along an axis that is orthogonal to the longitudinal axis of the header.

The present disclosure includes all novel and non-obvious combinations and sub-combinations of the various features and techniques disclosed herein. The various features and techniques disclosed herein are not necessarily required of all examples of the present disclosure. Furthermore, the various features and techniques disclosed herein may define patentable subject matter apart from the disclosed examples, and may find utility in other implementations not expressly disclosed herein.

The invention claimed is:

1. A gutter cover system, comprising:

a gutter section forming an open channel;

a gutter cover section including a header and a plurality of bristles coupled to the header, the header having a longitudinal axis that is located along a first side wall of the gutter section, the plurality of bristles distributed along the longitudinal axis of the header and projecting outward from the header in a first direction pointing away from a building structure and spanning at least a portion of the open channel of the gutter section from the first side wall towards a second side wall of the gutter section, the first side wall of the gutter section located closer to the building structure than the second side wall, a first flashing section coupled to the header and projecting outward from the header in a second direction that opposes the first direction, at least a terminal end of the first flashing section being located between a roof of the building structure and a roofing material of the building structure, and a second flashing section projecting downward from the header toward the gutter section at an angle to both the plurality of bristles and the first flashing section;

wherein the first flashing section and the second flashing section are continuous along an entire length of the header of the gutter cover section along the longitudinal axis.

2. The gutter cover system of claim 1, wherein the first flashing section projects outward from the header at an angle that is less than 180 degrees and greater than 90 degrees relative to the plurality of bristles.

3. The gutter cover system of claim 1, wherein the second flashing section is located closer to the building structure than an interior-facing side of the first side wall of the gutter section that defines at least a portion of the open channel.

4. The gutter cover system of claim 1, wherein the gutter cover section further includes a third flashing section projecting from a distal end of the second flashing section in a direction from which the plurality of bristles project from the header, the second flashing section and the third flashing section forming an L-shaped section; and wherein the third flashing section is continuous along the entire length of the header of the gutter cover section along the longitudinal axis.

5. The gutter cover system of claim 4, wherein the first flashing section, the second flashing section, and the third flashing section are formed from a single piece of sheet material.

6. The gutter cover system of claim 4, further comprising:

a fourth flashing section that covers a first side of the header along an interface between the header and the bristles;

wherein the fourth flashing section is continuous along the entire length of the header of the gutter cover section along the longitudinal axis.

7. The gutter cover system of claim 6, wherein the first flashing section, the second flashing section, the third flashing section, and the fourth flashing section are formed from a single piece of sheet material.

8. The gutter cover system of claim 1, wherein the plurality of bristles are arranged in a plurality of layers along an axis that is orthogonal to the longitudinal axis of the header.

9. A gutter cover section, comprising:

a header having a longitudinal axis; and a plurality of bristles distributed along the longitudinal axis of the header and projecting outward from the header in a first direction that is orthogonal to the longitudinal axis of the header to span at least a portion of an open channel of a gutter section;

a first flashing section coupled to the header and projecting outward from the header in a second direction that opposes the first direction, the first flashing section configured to be placed between a roof of a building structure and a roofing material of the building structure; and a second flashing section projecting downward relative to the header toward at an angle to both the plurality of bristles and the first flashing section;

wherein the first flashing section and the second flashing section are continuous along an entire length of the header of the gutter cover section along the longitudinal axis.

10. The gutter cover section of claim 9, wherein the first flashing section projects outward from the header at an angle that is less than 180 degrees and greater than 90 degrees relative to the plurality of bristles.

11. The gutter cover section of claim 9, wherein the gutter cover section further includes a third flashing section projecting from a distal end of the second flashing section first segment in a direction from which the plurality of bristles project from the header, the second flashing section and the third flashing section forming an L-shaped section; and wherein the third flashing section is continuous along the entire length of the header of the gutter cover section along the longitudinal axis.

12. The gutter cover section of claim 11, wherein the first flashing section, the second flashing section, and the third flashing section are formed from a single piece of sheet material.

13. The gutter cover section of claim 11, further comprising:

a fourth flashing section that covers a first side of the header along an interface between the header and the bristles;

wherein the fourth flashing section is continuous along the entire length of the header of the gutter cover section along the longitudinal axis.

14. The gutter cover section of claim 13, wherein the first flashing section, the second flashing section, the third flashing section, and the fourth flashing section are formed from a single piece of sheet material.

15. The gutter cover section of claim 9, wherein the plurality of bristles are arranged in a plurality of layers along an axis that is orthogonal to the longitudinal axis of the header.

* * * * *